US006824015B1

(12) United States Patent
Ammann

(10) Patent No.: US 6,824,015 B1
(45) Date of Patent: Nov. 30, 2004

(54) CLOSURE DEVICE FOR CLOSING OFF THE DISPENSING ORIFICE OF A FLUID DISPENSER

(75) Inventor: Claude Ammann, Epalinges (CH)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 09/958,097

(22) PCT Filed: Apr. 6, 2000

(86) PCT No.: PCT/FR00/00863

§ 371 (c)(1),
(2), (4) Date: Oct. 5, 2001

(87) PCT Pub. No.: WO00/61454

PCT Pub. Date: Oct. 19, 2000

(30) Foreign Application Priority Data

Apr. 9, 1999 (FR) ..... 99 04475

(51) Int. Cl.[7] ..... B67D 1/16
(52) U.S. Cl. ..... 222/108; 222/562; 222/148
(58) Field of Search ..... 222/108, 562, 222/148; 422/28

(56) References Cited

U.S. PATENT DOCUMENTS

| | | | | | |
|---|---|---|---|---|---|
| 4,463,880 | A | * | 8/1984 | Kramer et al. | 222/189.08 |
| 5,014,869 | A | * | 5/1991 | Hammond | 220/712 |
| 5,105,993 | A | * | 4/1992 | La Haye et al. | 222/189.09 |
| 5,433,343 | A | * | 7/1995 | Meshberg | 222/25 |
| 5,451,369 | A | * | 9/1995 | Daeschel et al. | 422/28 |
| 5,516,006 | A | * | 5/1996 | Meshberg | 222/25 |
| 5,694,978 | A | * | 12/1997 | Heilmann et al. | 138/89 |
| 6,000,580 | A | * | 12/1999 | Nilson | 222/108 |
| 6,095,376 | A | * | 8/2000 | Hennemann et al. | 222/190 |
| 6,116,468 | A | * | 9/2000 | Nilson | 222/108 |
| 6,405,868 | B1 | * | 6/2002 | Bougamont et al. | 206/484 |

* cited by examiner

*Primary Examiner*—Kevin Shaver
*Assistant Examiner*—Stephanie Willatt
(74) *Attorney, Agent, or Firm*—Sughrue Mion, PLLC

(57) ABSTRACT

A closure device for closing off the dispensing orifice (5) of a fluid dispenser. The closure device comprising a removable cap (10) provided with a closure element (20) which, in the closed position, closes off the orifice (5). The closure device being characterized in that the closure element (20) is provided with a bactericidal and/or bacteriostatic substance which acts on the small quantity of fluid remaining at the orifice (5) after the dispenser has been actuated.

13 Claims, 2 Drawing Sheets

CLOSURE DEVICE FOR CLOSING OFF THE DISPENSING ORIFICE OF A FLUID DISPENSER

Figure 1:
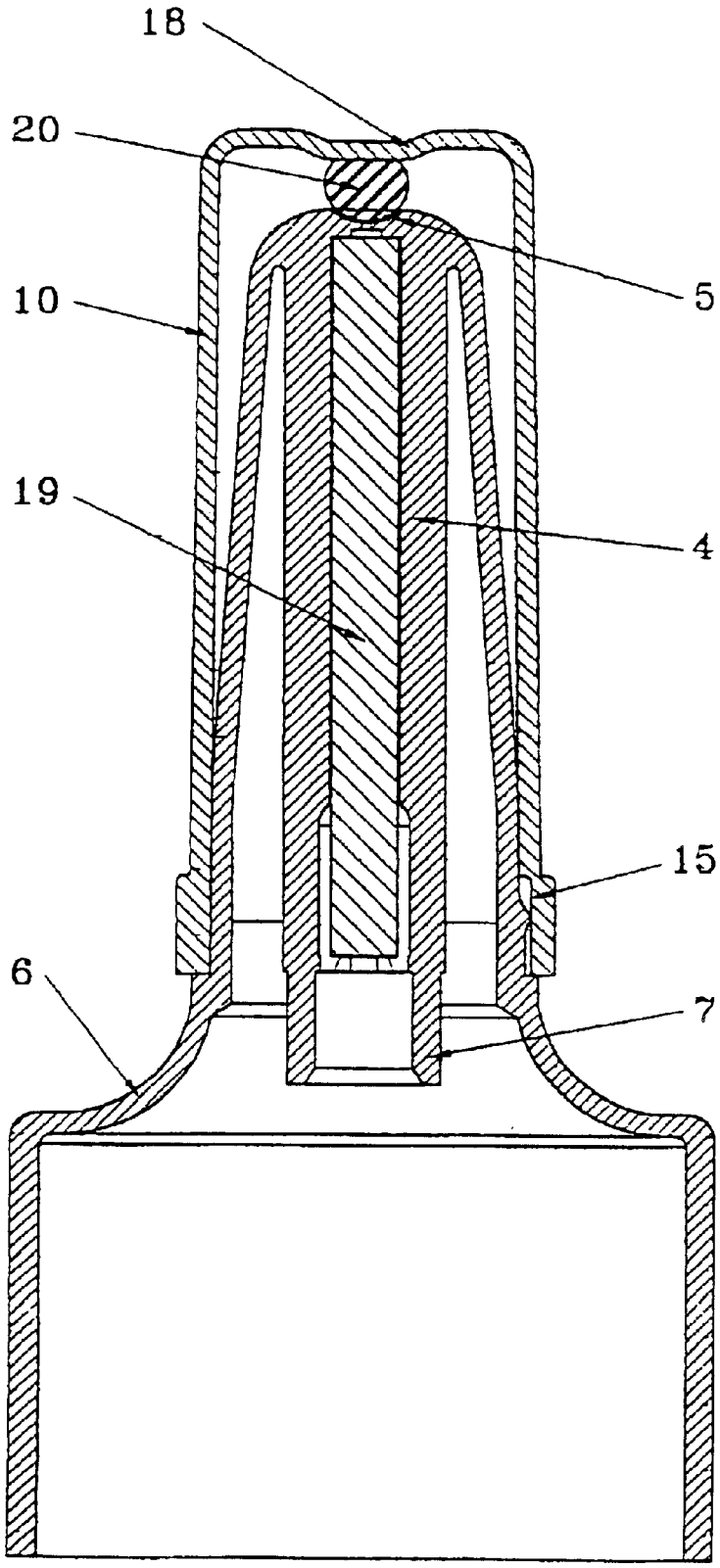

The present invention relates to a closure device for closing off a dispensing orifice of a fluid dispenser, and it also relates to a dispensing head and a fluid dispenser including such a closure device.

It is known from the state of the art that a removable cap can be used to close off the dispensing orifice of such a dispenser.

Document WO 98/00354 discloses a removable cap which, when in place, closes off the dispensing orifice in fluid-tight manner by means of a closure element, in particular a deformable pad, disposed against the end wall of the cap. That device provides good fluid-tightness but does not prevent contamination, in particular bacterial contamination, of the small quantity of fluid that remains in the vicinity of the orifice of the dispenser after the dispenser has been actuated. As a result, the next time the dispenser is actuated, there is a risk that a small quantity of contaminated fluid might be dispensed.

Document WO 93/24164 discloses a split cap suitable for enabling the dispensing portion to be dried rapidly. That cap can be provided with an absorbant pad on the inside of its end wall, it being possible for the absorbant pad to be imbibed with a suitable preservative agent. The function of that pad is to enable drying to take place rapidly and it does not act as a closure element.

An object of the present invention is to provide a closure device that does not suffer from the above-mentioned drawbacks.

In particular, an object of the present invention is to provide a closure device that prevents any bacterial contamination occurring at the dispensing orifice between occasions on which the dispenser is actuated.

Another object of the present invention is to provide a closure device that is simple and inexpensive to manufacture and to assemble.

An object of the present invention is to provide such a closure device that is easy for the user of the dispenser to use.

The present invention thus provides a closure device for closing off the dispensing orifice of a fluid dispenser, the closure device comprising a removable cap provided with a closure element which, in the closed position, closes off said orifice, said closure element being provided with a bactericidal and/or bacteriostatic substance which acts on the small quantity of fluid remaining at said orifice after the dispenser has been actuated.

Advantageously, the closure element has an inside shape that corresponds to the outside profile of the closure orifice.

Preferably, said closure element is implemented in the form of a ball.

Advantageously, the closure element is disposed on an end wall of the cap and projects from said end wall.

In a first variant, the closure element is made of a material incorporating the bactericidal and/or bacteriostatic substance.

In a second variant, the closure element is coated with the bactericidal and/or bacteriostatic substance.

Advantageously, said bactericidal and/or bacteriostatic substance acts by contact only, without releasing ions into the fluid.

The present invention also provides a dispensing head of a fluid dispenser, said dispensing head being provided with a dispensing orifice, and including a closure device as defined above for closing off said orifice.

Advantageously, the dispensing head is a nasal applicator pusher provided with a central axial dispensing orifice disposed at the bottom of a dish provided in the end of said dispensing head, said cap being implemented in the form of a hollow sleeve that can be fixed around said nasal applicator pusher, said cap being provided with a ball fixed to the end wall of said cap, the diameter of said ball corresponding substantially to the diameter of the dish so that, when the cap is in the closed position, said ball eliminates any presence of fluid in said dish.

The present invention also provides a fluid dispenser having a fluid reservoir and a dispensing head, such as a pusher, provided with a dispensing orifice, said fluid dispenser including a closure device as defined above for closing off said dispensing orifice.

Figure 2:
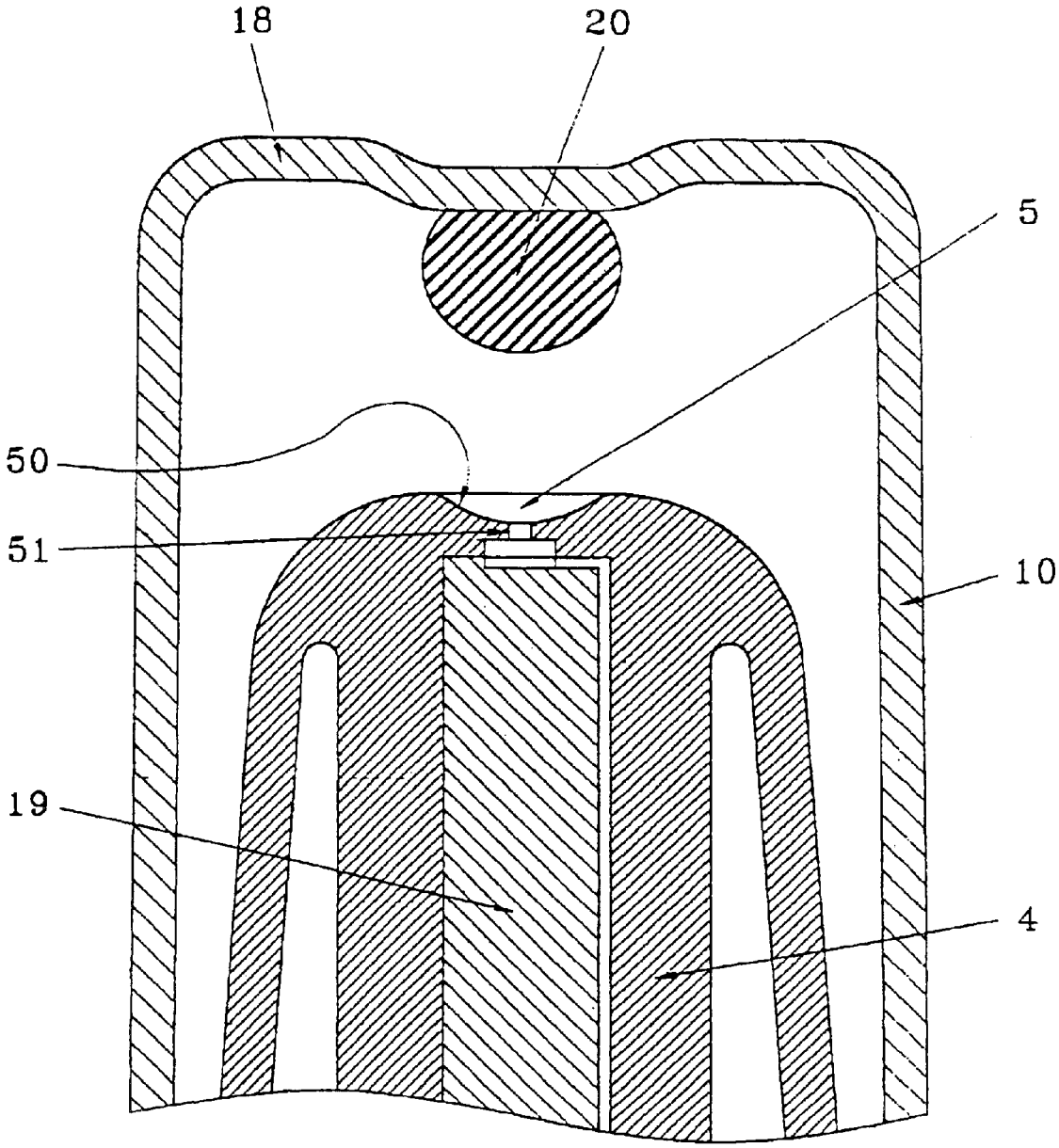

Other characteristics and advantages of the present invention appear from the following description of an advantageous embodiment of the invention, given by way of non-limiting example and with reference to the accompanying drawings, in which:

FIG. 1 is a diagrammatic view in longitudinal section through a closure device in a preferred embodiment of the invention, in the closed position; and FIG. 2 is an enlarged fragmentary view of the device of FIG. 1, in the open position.

The present invention covers both a closure device and also a dispensing head and a fluid dispenser having such a closure device. Since the closure device of the invention is applicable to all types of dispenser, the dispenser is not described in detail below.

Likewise, the dispenser head 4 shown in the drawings is a pusher for a nasal applicator, but the closure device of the invention is not limited to this type of pusher. Indeed, the invention is applicable to the orifice of any fluid dispenser in which the fluid might otherwise become contaminated.

As shown in FIG. 1, the nasal applicator pusher 4 is provided with an axial dispensing orifice 5 at its end. At its other end, it has an abutment surface 6 for actuating the dispenser and connection means 7 for connecting the head 4 to a dispensing member, such as a pump (not shown). Advantageously, in the expulsion channel leading to the orifice 5, the head has a spray insert 19 for limiting the dead volume. The head may also be provided with closure means disposed upstream from the orifice.

The closure device comprises a removable cap 10 which, in its closed position (as shown in FIG. 1), closes off the dispensing orifice 5. For this purpose, said cap is provided with a closure element 20. This closure element may advantageously be disposed on an end-wall 18 of the cap 10, and it is preferably implemented in the form of a ball.

In the invention, said closure element 20 is provided with a bactericidal and/or bacteriostatic substance acting on the fluid remaining at said orifice 5 after the dispenser has been actuated. The bactericidal and/or bacteriostatic substance may be incorporated in the material of which the closure element 20 is made, or else it may be coated on said closure element 20. Preferably, said bactericidal and/or bacteriostatic substance acts by contact only, without releasing ions into the fluid.

As shown in FIG. 2, which is an enlarged diagrammatic view of the closure device of FIG. 1 in the open position, it can be seen that the dispensing orifice 5 of the nasal applicator pusher 4 is provided in the bottom of a sort of dish 50 provided in the top end wall of said head 4. This embodiment corresponds to a typical nasal applicator dispensing head. In this case, it is preferable for the closure element 20 of the closure device to have an outside shape that corresponds substantially to the shape of said dish 50. In this way, when the cap 10 is in the closed position, any fluid remaining in said dish 50 after the dispenser has been actuated is removed by the closure element that comes to occupy the corresponding volume. Thus, the closure element 20 is advantageously implemented in the form of a ball whose diameter corresponds substantially to the diameter of said dish 50. When the cap 10 is in the closed position, as shown in FIG. 1, the bactericidal and/or bacteriostatic substance of said closure element 20 advantageously acts on the small quantity of fluid contained in the short channel 51 (visible in FIG. 2) which forms the dispensing orifice 5 and connects the expulsion channel of the head 4 to the bottom of said dish 50. Thus, any quantity of fluid remaining in the vicinity of said orifice 5 after the dispenser has been actuated is prevented from being contaminated by the cap 10 being put in place, specifically by means of the closure element 20 provided with a bactericidal and/or bacteriostatic substance.

Naturally, the present invention is not limited to the particular embodiment shown in the Figures and, in particular, the closure element 20 is not necessarily implemented in the form of a ball fitting into a dish provided in the end of the dispensing head. The present invention provides a closure element 20 that incorporates a bactericidal and/or bacteriostatic substance and that serves, when the cap 10 is in the closed position, to prevent any contamination of the fluid remaining in or in the vicinity of the dispensing orifice 5. Consideration may even be given to providing for the closure element 20 to penetrate into the dispensing orifice 5, if so desired. Similarly, the cap 10 is not necessarily implemented in the form of a hollow sleeve, as shown in the drawings, but rather it may have any suitable shape.

The cap 10 may be fixed in its closed position on the dispensing head 4, advantageously by snap-fastening. To this end, it may be provided with fixing means 15 such as one or more snap-fastening ribs which snap-fasten to a portion of said head 4. Naturally, the fixing means 15 for fixing the cap 10 to the head 4 may have any suitable shape. Thus, the cap 10 may be screwed onto the head 4, or else be fixed to some other element of the dispenser, such as, for example, the fluid receptacle (not shown).

The present invention thus provides a closure device for closing off the dispensing orifice 5 of a fluid dispenser that is easy to put in place and to remove, that guarantees closure of the orifice 5 in the closed position, and that simultaneously prevents any contamination of the fluid at said dispensing orifice 5 in said closed position.

What is claimed is:

1. A closure device for closing off a dispensing orifice (5) of a fluid dispenser, the closure device comprising a removable cap (10) provided with a closure element (20) which, in a closed position, closes off said orifice (5), said closure device being characterized in that the closure element (20) is provided with a bactericidal and/or bacteriostatic substance which acts on a small quantity of fluid remaining at said orifice (5) after the dispenser has been actuated; and wherein the closure element, when in the closed position, seals the orifice so that the orifice is not in communication with ambient air that surrounds the closure element; and wherein the closure element is made from a material that does not absorb fluid.

2. A closure device according to claim 1, in which the closure element (20) has an outside shape that corresponds to the outside profile of the closure orifice (5).

3. A closure device according to claim 1, in which said closure element (20) is implemented in the form of a ball.

4. A closure device according to claim 1, in which the closure element (20) is disposed on an end wall (18) of the cap (10) and projects from said wall.

5. A closure device according to claim 1, in which the closure element (20) is made of a material incorporating the bactericidal and/or bacteriostatic substance.

6. A closure device according to claim 1, in which the closure element (20) is coated with the bactericidal and/or bacteriostatic substance.

7. A closure device according to claim 1, in which said bactericidal and/or bacteriostatic substance acts by contact only, without releasing ions into the fluid.

8. A dispensing head (4) of a fluid dispenser, said dispensing head (4) being provided with a dispensing orifice (5), said dispensing head comprising a closure device (10, 20) for closing off said orifice (5); and wherein the closure device comprises a removable cap (10) provided with a closure element (20) which, in a closed position, closes off the orifice (5), said closure device being characterized in that the closure element (20) is provided with a bactericidal and/or bacteriostatic substance that acts on a small quantity of fluid remaining at said orifice (5) after the dispenser has been actuated;

wherein the closure element, when in the closed position, seals the orifice so that the orifice is not in communication with ambient air that surrounds the closure element; and wherein the closure element is made from a material that does not absorb fluid.

9. A dispensing head according to claim 8, in which the dispensing head (4) is a nasal applicator pusher; and wherein the dispensing orifice is a central axial dispensing orifice (5) disposed at the bottom of a dish (50) provided in the end of said dispensing head (4), said cap (10) being implemented in the form of a hollow sleeve that can be fixed around said nasal applicator pusher (4), said cap (10) being provided with a ball (20) fixed to the end wall (18) of said cap (10), the diameter of said ball (20) corresponding substantially to the diameter of the dish (50) so that, when the cap (10) is in the closed position, said ball removes any presence of fluid in said dish (50).

10. A fluid dispenser having a fluid reservoir and a dispensing head (4) provided with a dispensing orifice (5), said fluid dispenser comprising a closure device (10, 20) for closing off said dispensing orifice (5); and wherein the closure device comprises a removable cap (10) provided with a closure element (20) which, in a closed position, closes off the orifice (5), the closure device being characterized in that the closure element (20) is provided with a bactericidal and/or bacteriostatic substance that acts on a small quantity of fluid remaining at said orifice (5) after the dispenser has been actuated;

wherein the closure element, when in the closed position, seals the orifice so that the orifice is not in communication with ambient air that surrounds the closure element; and wherein the closure element is made from a material that does not absorb fluid.

11. The fluid dispenser according to claim 10, wherein the dispenser head is pusher.

12. The fluid dispenser according to claim 10, wherein the closure element is made from a material that does not absorb the small quantity of fluid remaining at the orifice after the dispenser has been actuated.

13. A closure device for closing off a dispensing orifice of a fluid dispenser, the closure device comprising a removable cap provided with a closure element which, in a closed position, closes off said orifice, said closure device being characterized in that the closure element is provided with a bactericidal and/or bacteriostatic substance which acts on a small quantity of fluid remaining at said orifice after the dispenser has been actuated; and wherein the closure element is made from a material that does not absorb fluid.

* * * * *